United States Patent [19]

Akasaka et al.

[11] Patent Number: 5,012,773

[45] Date of Patent: May 7, 1991

[54] INTAKE- AND/OR EXHAUST-VALVE TIMING CONTROL SYSTEM FOR INTERNAL COMBUSTION ENGINE

[75] Inventors: Akio Akasaka; Seiji Suga; Yasuo Fukuda; Takanori Sawada, all of Kanagawa, Japan

[73] Assignee: Atsugi Motor Parts Company, Limited, Kanagawa, Japan

[21] Appl. No.: 395,582

[22] Filed: Aug. 18, 1989

[30] Foreign Application Priority Data

Aug. 18, 1988 [JP] Japan ..... 63-108490[U]

[51] Int. Cl.[5] ..... F01L 1/34

[52] U.S. Cl. ..... 123/90.17; 123/90.31

[58] Field of Search ..... 123/90.15, 90.17, 90.31

[56] References Cited

U.S. PATENT DOCUMENTS

| | | | |
|---|---|---|---|
| 4,231,330 | 11/1980 | Garcea | 123/90.15 |
| 4,421,074 | 12/1983 | Garcea et al. | 123/90.15 |
| 4,535,731 | 8/1985 | Banfi | 123/90.17 |
| 4,811,698 | 3/1989 | Akasaka et al. | 123/90.17 |
| 4,856,465 | 8/1989 | Denz et al. | 123/90.15 |
| 4,889,086 | 12/1989 | Scapecchi et al. | 123/90.15 |

FOREIGN PATENT DOCUMENTS

| | | | |
|---|---|---|---|
| 0296885 | 12/1988 | European Pat. Off. | 123/90.17 |
| 3444277 | 6/1986 | Fed. Rep. of Germany . | |
| 0003111 | 1/1987 | Japan | 123/90.17 |
| 62-66206 | 4/1987 | Japan . | |
| 602837 | 3/1948 | United Kingdom . | |
| 2152193 | 7/1985 | United Kingdom | 123/90.17 |

*Primary Examiner*—Charles J. Myhre
*Assistant Examiner*—Weilun Lo
*Attorney, Agent, or Firm*—Ronald P. Kananen

[57] ABSTRACT

An intake- and/or exhaust-valve timing control system for internal combustion engines in which a ring gear mechanism is provided between a timing pulley and a cam shaft for adjusting the phase angle between the pulley and the cam shaft. A drive mechanism is also provided for driving the ring gear mechanism depending upon the operating state of the engine. The drive mechanism includes a hydraulic circuit having oil supply and exhaust passages, a flow control valve having a spool valve for controlling the amount of working fluid flowing through the hydraulic circuit, a controller for monitoring the operating state of the engine, and an electromagnetic actuator having a plunger rod for actuating the flow control valve in response to the control signal from the controller. The flow control valve and the actuator are integrally mounted in the cylinder head. Therefore, relative friction between the facing ends of the spool valve and the plunger rod is avoided.

7 Claims, 2 Drawing Sheets

INTAKE- AND/OR EXHAUST-VALVE TIMING CONTROL SYSTEM FOR INTERNAL COMBUSTION ENGINE

BACKGROUND OF THE INVENTION

1. Field of the Invention

The present invention relates to an intake- and/or exhaust-valve timing control system which is optimally adapted for use in internal combustion engines. More particularly, this invention relates to a system which is variably capable of controlling the intake- and/or exhaust-valve timing depending upon the operating state of the engine, for example the magnitude of engine load and/or engine speed.

2. Description of the Prior Disclosure

Recently, there have been proposed and developed various intake- and/or exhaust-valve timing control systems for internal combustion engines for generating the optimal engine performance depending upon the operating state of the engine.

As is generally known, the valve timing is determined such that optimal engine performance is obtained; however the predetermined valve timing is not suitable under all operating conditions. As is well known, when the engine is operating within a range of low revolutions, higher torque will be obtained with an earlier intake/valve timing than the predetermined valve timing.

Such conventional intake- and/or exhaust-valve timing control systems for internal combustion engines have been disclosed in Japanese Utility Model (Jikkai) Showa 62-66206 and in U.S. Pat. No. 4,421,408. In these conventional valve timing control systems, a timing pulley is rotatably supported through a ring gear mechanism by the front end of a cam shaft. The ring gear mechanism includes a ring gear having an inner helical gear engaging an outer helical gear portion fixed on the front end portion of the cam shaft and an outer helical gear engaging an inner helical gear portion formed on the inner peripheral wall of the timing pulley. In this manner, the ring gear rotatably engages between the timing pulley and the cam shaft. The ring gear is normally biased in the axial direction of the cam shaft by spring means, such as a coil spring. Under this condition, the intake- and/or exhaust-valve timing is in general set to a predetermined valve timing. The conventional valve timing control system also includes an oil flow control valve assembly disposed in the cam shaft for controlling the flow of oil supplied to a pressure chamber defined between the timing pulley and the front end portion of the cam shaft and an electromagnetic actuator assembly attached to a rocker cover for operating the flow control valve. The flow control valve assembly and the electromagnetic actuator assembly are coaxially arranged with respect to each other. The actuator assembly employs a substantially cylindrical plunger which is normally biased to the innermost position thereof by the spring. The flow control valve assembly employs a substantially cylindrical spool valve which is normally biased to the outermost position, wherein the outer end of the plunger and the outer end of the spool valve abut each other, by means of a spring. When the actuator is activated, the plunger is shifted from the innermost position to the outermost position, and as a result the spool valve is moved from the outermost position to the innermost position, alternately moving between the oil supply passage and the oil exhaust passage, opening each passage in turn. In these constructions, when the actuator is excited, the flow control valve is controlled such that working fluid (operating oil) having high pressure, via the engine oil pump, is supplied from the oil pan through the flow control valve to the pressure chamber, and thus the ring gear is rotated and moved in an axial direction opposing the direction of the spring bias provided. Therefore, the phase angle between the timing pulley and the cam shaft is slightly changed, with the result that the valve timing relative to the crank angle is variably controlled. Conversely, when the actuator is deactivated, the flow control valve is controlled such that the working fluid is supplied from the oil pan through the control valve to the internal space defined by the cylinder head.

However, in conventional valve timing control systems, the spool valve of the flow control valve assembly is rotated relative to the plunger of the actuator assembly in a state wherein the facing ends of the spool valve in the flow control valve and the plunger of the actuator assembly continuously abut each other irrespective of whether or not the actuator is activated; therefore, abrasion occurs between the ends of the plunger and the spool valve. This results in reduction of the stroke of the spool valve. As a result, flow control to the ring gear mechanism may not be efficiently performed.

As previously described, since conventional valve timing control systems are designed such that the working fluid is discharged through the flow control valve into the internal space in the cylinder head, in internal combustion engines having positive crankcase ventilation (PCV) systems, a portion of the working fluid is mixed with the blow-by fumes and other vapors in the crankcase or in the cylinder head. Therefore, the working fluid may deteriorate. When the blow-by gas including a portion of the working fluid is introduced through the PCV valve which is provided to regulate the flow of blow-by gas from the crankcase, into the intake manifold, the blow-by gas is mixed with the incoming air-fuel mixture and sent to the cylinders for burning. As a result, the concentration of pollutants discharged from the exhaust valve into the atmosphere is increased, thereby reducing emission control performance. For this reason, internal combustion engines with conventional valve timing control systems require separators, such as a baffle plate and steel screen, for separating the working fluid from the blow-by fumes. These parts increase the overall cost of the engine.

SUMMARY OF THE INVENTION

It is, therefore, in view of the above disadvantages, an object of the present invention to provide an intake- and/or exhaust-valve timing control system for internal combustion engines with high durability in which the valve timing is variably controlled depending upon the operating state of the engine, for example the magnitude of engine load and/or engine speed.

It is another object of the invention to provide an intake- and/or exhaust-valve variable timing control system having optimum emission performance for internal combustion engines in which working fluid used by the timing control system is not mixed with blow-by gas in the cylinder head.

According to one aspect of the invention, an intake- and/or exhaust-valve timing control system for an internal combustion engine includes a gear mechanism disposed between a timing pulley and a cam shaft for adjusting the phase angle between the pulley and the cam shaft, and a drive mechanism provided for drivingly controlling the gear mechanism via oil pressure depending upon the operating state of the engine. The drive mechanism includes a hydraulic circuit having an oil supply passage for supplying working fluid from an oil pressure source for pressurizing the working fluid, such as an oil pump, to the gear mechanism and an oil exhaust passage for the outlet of the fluid from the gear mechanism to an oil pan of the engine. A flow control valve is disposed in the hydraulic circuit at a location other than a portion of the hydraulic circuit provided at the cam shaft for controlling the amount of working fluid flowing through the hydraulic circuit, and means provided for monitoring the operating state of the engine, the monitoring means generating a control signal representative of the operating state of the engine is also provided. An actuator is disposed for actuating the flow control valve in response to the control signal from the monitoring means.

According to another aspect of the invention, an intake- and/or exhaust-valve timing control system for an internal combustion engine includes a gear mechanism disposed between a timing pulley and a cam shaft for adjusting the phase angle between the pulley and the cam shaft, a drive mechanism, provided for drivingly controlling the gear mechanism via oil pressure depending upon the operating state of the engine. The drive mechanism includes a hydraulic circuit having an oil supply passage passing through the cylinder head of the engine for supplying working fluid from an oil pressure source for pressurizing the working fluid to the gear mechanism and an oil exhaust passage passing through the cylinder head for the outlet of the fluid from the gear mechanism to an oil pan. A flow control valve is disposed in the cylinder head for controlling the amount of working fluid flowing through the hydraulic circuit, and means provided for monitoring the operating state of the engine, the monitoring means generating a control signal representative of the operating state of the engine is also provided. An actuator is disposed for actuating the flow control valve in response to the control signal from the monitoring means. The flow control valve and the actuator are integrally assembled and are mounted together on the cylinder head. In the cylinder head, the oil supply passage and the oil exhaust passage are juxtaposed and the flow control valve is arranged in such a manner as to traverse both the oil supply and oil exhaust passages. The flow control valve includes a spool valve for blocking the oil supply passage and for establishing the oil exhaust passage or for blocking the oil exhaust passage and for establishing the oil supply passage. The spool valve includes a first valve section for blocking and establishing the oil supply passage and a second valve section for blocking and establishing the oil exhaust passage, the first valve section having a substantially annular groove at the outer peripheral surface thereof such that a slight amount of the working fluid is fed through the annular groove to the gear mechanism so as to provide lubrication of the gear mechanism when the oil supply passage is blocked by the first valve section. The actuator includes a plunger rod capable of moving the spool valve, and the spool valve and the plunger rod move integrally with each other while the facing ends of the spool valve and the plunger rod abut each other.

BEST MODE FOR CARRYING OUT THE INVENTION

Figure 1:
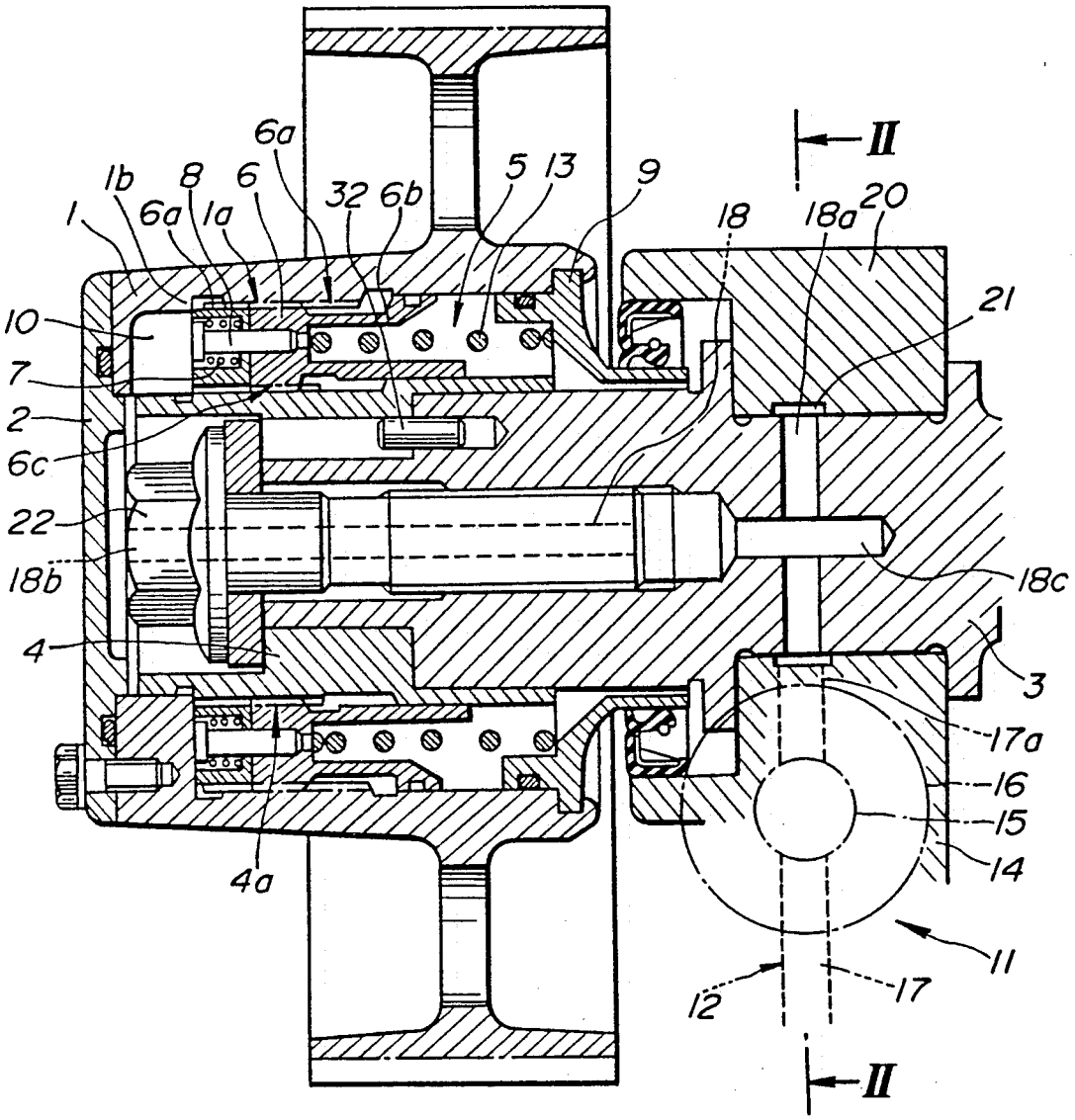
FIG. 1 is a cross sectional view illustrating a preferred embodiment of an intake- and/or exhaust-valve timing control system for internal combustion engines according to the invention.
Figure 2:
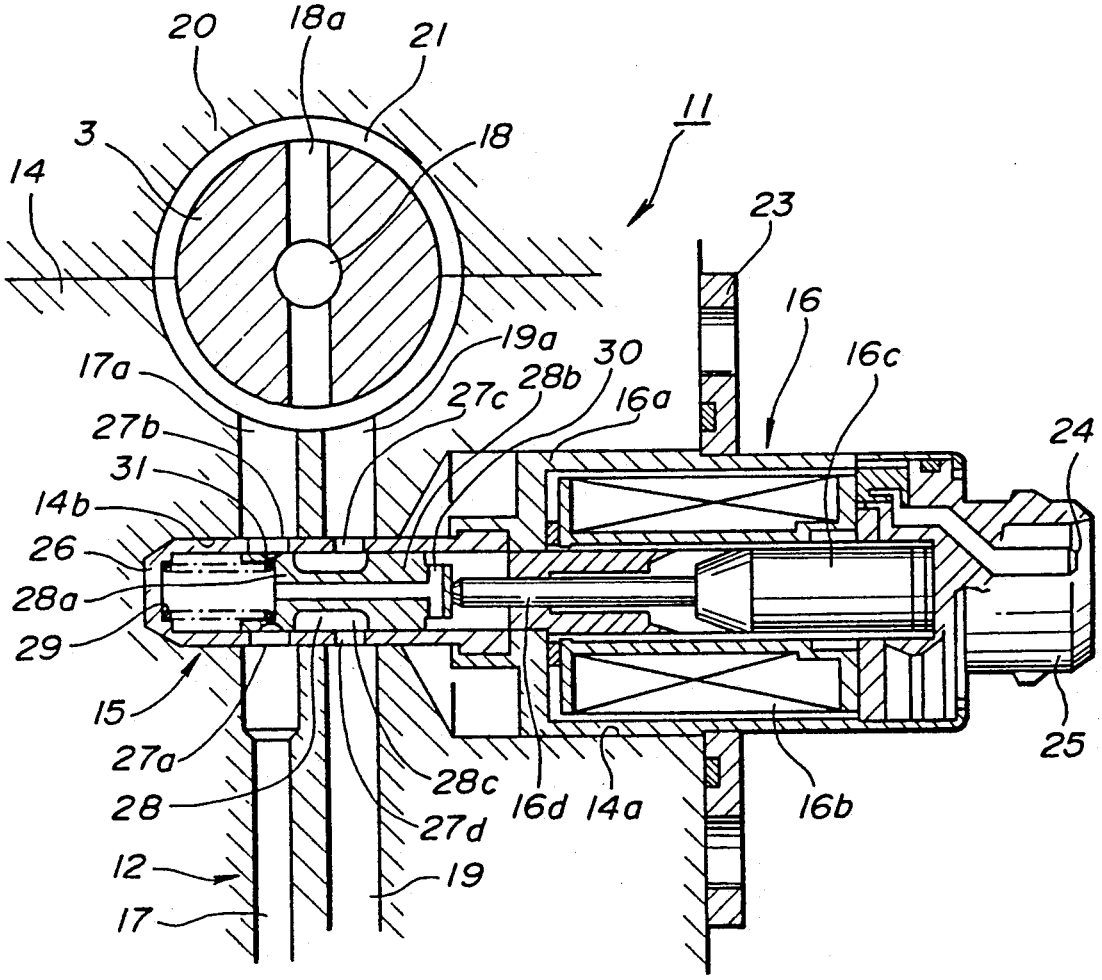
FIG. 2 is a cross sectional view taken along line II—II of FIG. 1.

The principles of the present invention applied to intake- and/or exhaust-valve timing control systems for internal combustion engines are illustrated in FIGS. 1 and 2.

FIG. 1 shows a front end section of a cam shaft 3 provided for opening and closing an intake- and/or exhaust-valve (not shown). As clearly seen in FIG. 1, the cam shaft 3 is journalled by a cylinder head 14 and a bearing member 20. Reference numeral 1 denotes a timing pulley driven by a timing belt or a timing chain. The timing pulley 1 is hermetically closed by a front lid 2 at the front end of the substantially annular hub thereof in an air tight fashion. The pulley 1 also includes an inner helical gear 1*a* at the inner peripheral surface thereof. A sleeve 4 having an outer helical gear 4*a* is firmly connected to the outer peripheral surface of the front end of the cam shaft 3 by a bolt 22 and a pin 32. A ring gear mechanism 5 is provided between the timing pulley 1 and the sleeve 4. The ring gear mechanism 5 includes a ring gear member 6 which is comprised of a first gear section 6*a* and a second gear section 6*b*, a plurality of coil springs 7, and a plurality of connecting pins 8 which are fixed through the annular hollow defined in the first gear section 67*a* on the second gear section 6*b* as seen in FIG. 1. the first gear section 6*a* is normally biased to the direction of the second gear section 6*b* by the springs 7. The first and second gear sections 6*a* and 6*b* respectively include an inner helical gear 6*c* engaging the outer helical gear 4*a* of the sleeve 4 and an outer helical gear 6*d* engaging the inner helical gear 1*a* of the pulley 1. The axially forward movement of the first gear section 6*a* is restricted by an inner shoulder formed on the inner periphery of the pulley 1 in such a manner that the front end of the first gear section 6*a* abuts the shoulder lb. On the other hand, the axially backward movement of the second gear section 6*b* is restricted by the front end of a substantially annular retainer 9 which is fixed on the rear end portion of the hub of the pulley 1 by caulking. An annular pressure chamber 10 is defined by the inner peripheral surface of the pulley 1, the outer peripheral surface of the sleeve 4, and the front end surface of the first gear section 6*a* for introducing working fluid fed from the oil pan (not shown) via the engine oil pump (not shown).

A drive mechanism 11 for the previously described ring gear member 6 comprises a hydraulic circuit 12 for supplying and draining the working fluid from the oil pan (not shown) to the pressure chamber 10, a compression spring 13 disposed between the second gear section 6*b* and the retainer 9 for normally biasing the ring gear member 6 in an axially forward direction, a flow control valve assembly 15 provided in the cylinder head 14 for controlling the amount of the working fluid flowing through the hydraulic circuit 12, and an electromagnetic actuator assembly 16 provided in the cylinder head 14 for actuating the flow control valve assembly 15. As shown in FIGS. 1 and 2, the hydraulic circuit 12 includes an oil supply passage 17, an intermediate oil passage 18, and an oil exhaust passage 19. The oil supply passage 17 communicates through a main oil gallery (not shown) with the oil pump (not shown) upstream thereof and also communicates at its downstream section 17*a* with an annular oil passage 21 defined between the outer peripheral surface of the front journalled section of the cam shaft 3 and the semi-circular curved surface of the cylinder head 14 and the bearing member 20. The intermediate oil passage 18 includes a radial oil passageway 18*a* diametrically passing through the front journalled section of the cam shaft 3, an axial oil passageway 18*b* formed in the bolt 22 to communicate with the pressure chamber 10, and an axial oil passageway 18*c* bored in the front end portion of the cam shaft 3 in such a manner as to intercommunicate with the oil passageway 18*a* and the oil passageway 18*b*. As clearly seen in FIG. 2, the oil supply and oil exhaust passages 17 and 19 are parallel to each other in the cylinder head 14. The exhaust passage 19 communicates at its upstream section 19*a* with the annular oil passage 21 and also communicates with the oil pan (not shown) downstream thereof.

According to the preferred embodiment of the invention, the actuator assembly 16 is disposed in a relatively large bore 14*a* bored in the side wall of the cylinder head 14 and while the flow control valve assembly 15 is disposed in a relatively small bore 14*b* which extends from the large bore 14*a* and penetrates the two oil passages 17 and 19. The actuator assembly 16 has a cylindrical casing 16*a* which is fixed in the large bore 14*a* of the cylinder head 14 through a fixture 23. An electromagnetic coil 16*b* and a plunger 16*c* having a small push rod 16*d* are provided in the casing 16*a*. The actuator assembly 16 also includes a connector 25 having an input terminal 24 disposed at the outermost portion thereof for inputting a signal output from a controller (not shown) which is provided for monitoring the operating state of the internal combustion engine. In addition, the flow control valve assembly 15 includes a valve body 26 which is caulkingly fixed on the top end of the casing 16*a* and is inserted into the small bore 14*b*. The valve body 26 has diametrically opposing first and second openings 27*a* and 27*b* which are formed on the periphery thereof along the axial direction of the upstream section 17*a* of the oil supply passage 17 and diametrically opposing third and fourth openings 27*c* and 27*d* which are formed on the periphery thereof along the axial direction of the downstream section 19*a* of the oil exhaust passage 19. A spool valve 28 is slidably disposed in the valve body 26 for opening and closing the oil supply passage 17 and the oil exhaust passage 19. The spool valve 28 is comprised of a first valve section 28*a* for opening and closing the oil supply passage 17 and a second valve section 28*b* for opening and closing the oil exhaust passage 19. As best seen in FIG. 2, a coil spring 29 is disposed between the inner wall of the top end of the valve body 26 and the left end of the first valve section 28*a* with the result that the spool valve 28 is normally biased to the right (viewing FIG. 2) and the right end of the spool valve 28 is continuously pushed against the top end of the rod 16*d* of the plunger 16*c*. Under this condition, the oil supply passage 17 is closed, while the oil exhaust passage 19 is fully opened. The spool valve 28 also includes a communication passage 30 which is axially penetrated and divided into upward and downward passageways at the right end thereof. Through the communication passage 30, both oil chambers defined at both sides of the spool valve 28 are intercommunicated and thus the spool valve slide smoothly. The spool valve 28 further includes an annular concavity 28*c* formed on the substantially central outer peripheral surface thereof. As clearly seen in FIG. 2, depending on the position of the spool valve 28, the first and second openings 27*a* and 27*b* or the third and fourth openings 27*c* and 27*d* are intercommunicated through the annular concavity 28*c*. In addition, the first valve section 28*a* includes an annular oil groove 31 at the outer peripheral surface thereof. The first valve section 28*a* permits the working fluid to flow through the oil groove 31, when the oil supply passage 17 is closed.

The intake- and/or exhaust-valve timing control system for internal combustion engines according to the invention, operates as follows.

When the engine is operating under low load, the control signal from the previously described controller is in an OFF state, with the result that the actuator assembly 16 is not activated by the controller. Therefore, as shown in FIG. 2, the plunger 16*c* remains in the innermost position thereof and as a result the spool valve 28 is retained by the spring 29 in an exhaust position wherein the first valve section 28*a* blocks the first and second openings 27*a* and 27*b* and thus the oil supply passage 17 is closed and the second valve section 28*b* establishes the third and fourth openings 27*c* and 27*d* and thus the oil exhaust passage 19 is fully opened. Therefore, the working fluid in the intermediate oil passage 18 and the annular oil passage 21 is returned through the upstream section 19*a* of the exhaust oil passage 19, the third opening 27*c*, the annular concavity 28*c*, and the fourth opening 27*d* to the oil pan in that order. On the other hand, the oil flow through the oil supply passage 17 is blocked by the first valve section; however a portion of the working fluid fed from the oil pump to the oil supply passage 17 is supplied through the first opening 27*a*, the annular groove 31, the second opening 27*b*, the downstream section 17*a* of the oil supply passage 17, and the annular oil passage 21 via the intermediate oil passage 18 to the pressure chamber 10. However, since the amount of oil exhausted through the oil exhaust passage 19 is considerably greater than that of the oil supplied through the oil supply passage 17, the pressure within the pressure chamber 10 becomes low. As a result, as shown in FIG. 1, the ring gear member 6 is positioned at the leftmost position (viewing FIG. 1) by the spring 13. Under this condition, the relative phase angle between the timing pulley 1 and the cam shaft 3 is set to a predetermined phase angle in which an intake- and/or exhaust-valve timing relative to the crank angle is initialized. Furthermore, the slight amount of working fluid supplied to the pressure chamber 10 serves to lubricate the ring gear mechanism 5, thereby resulting in high responsiveness of the ring gear mechanism 5.

Conversely, when the operating state of the engine is changed from a low load to a high load, the control signal from the controller is output via the input terminal 24 of the connector 25 to the electromagnetic coil 16*b* with the result the actuator assembly 16 is activated by the signal from the controller. Therefor the plunger 16*c* is moved to the outermost position thereof and as a result the rod 16*d* pushes the left end of the spool valve 28 as the spool valve 28 is moved from the leftmost position to the rightmost position against the spring force generated by the spring 29. In other words, the spool valve 28 is positioned in a supply position wherein the second valve section 28*b* blocks the third and fourth openings 27*c* and 27*d* and thus the oil exhaust passage 19 is fully closed and the first valve section 28*a* establishes the first and second openings 27*a* and 27*b* and thus the oil supply passage 17 is fully opened. Therefore, the working fluid from the oil pump is supplied through the first opening 27*a*, the annular concavity 28*c*, the second opening 27*b*, the downstream section of the oil supply passage 17, the annular oil passage 21, and the intermediate oil passage 18 to the pressure chamber 10 in that order. As a result, since the pressure of the working fluid within the pressure chamber 10 becomes high, the ring gear member 6 is moved in the right direction (viewing FIG. 1) against the spring force generated by the spring 13. Therefore, the phase angle between the timing pulley 1 and the cam shaft 3 is relatively changed to a predetermined phase angle which corresponds to an optimal phase angle during high engine load conditions. In this manner, the intake- and/or exhaust valve timing is variably controlled dependent upon the operating state of the engine.

As will be appreciated from the above, since the flow control valve assembly is not provided in the cam shaft 3 but in the cylinder head along with the electromagnetic actuator assembly, relative movement between the spool valve of the flow control valve assembly and the plunger rod of the actuator is satisfactorily avoided. Therefore, rotational friction between the facing ends of the rod and the spool valve is satisfactorily avoided and as a result abrasion of the above is also sufficiently avoided. In addition, since the facing ends of the plunger rod and the spool valve continuously abut each other, impact between the facing ends when the actuator is activated is avoided, thereby preventing impact noise generated due to the collision between the plunger rod and the spool valve.

In the intake- and/or exhaust-valve timing control system according to the invention, since the electromagnetic actuator assembly and the flow control valve assembly are integrally assembled, these parts are easily mounted into small and large bores bored in the side wall of the cylinder head. Therefore, mounting efficiency of the actuator and the flow control valve assemblies is extremely high.

Moreover, the working fluid outlet from the oil exhaust passage 19 is directly returned into the oil pan, thereby preventing the working fluid from mixing with the blow-by gas contained in the cylinder head. Consequently, high emission control performance may be maintained.

While the foregoing is a description of the best mode for carrying out the invention, it will be understood that the invention is not limited to the particular embodiments shown and described herein, but may include variations and modifications without departing from the scope or spirit of this invention as described by the following claims.

What is claimed is:

1. An intake- and/or exhaust-valve timing control system for an internal combustion engine comprising:

a gear mechanism disposed between a timing pulley and a camshaft for adjusting the phase angle between said pulley and said camshaft;

a drive mechanism provided for drivingly controlling said gear mechanism via oil pressure depending upon the operating state of said engine;

said drive mechanism including;

a hydraulic circuit having an oil supply passage for supplying working fluid from an oil pressure source for pressurizing the working fluid to said gear mechanism and an oil exhaust passage for exhausting the working fluid from said gear mechanism to an oil pan of said engine;

a flow control valve disposed in said hydraulic circuit at a location included in a stationary member of said engine for controlling the amount of working fluid flowing through said hydraulic circuit;

said oil exhaust passage being communicated through said flow control valve with the oil pan in such a manner as to prevent working fluid exhausted therethrough from being mixed with blow-by fumes or other vapors in said engine;

said oil supply passage and said oil exhaust passage are juxtaposed and said flow control valve is arranged in such a manner as to traverse both said oil supply and oil exhaust passages;

means for monitoring the operating state of said engine, said monitoring means generating a control signal representative of the operating state of said engine; and an actuator for actuating said flow control valve in response to said control signal from said monitoring means.

2. In an intake- and/or exhaust-valve timing control system for an internal combustion engine including a gear mechanism disposed between a timing pulley and a cam shaft for adjusting the phase angle between said pulley and said cam shaft, a drive mechanism provided for drivingly controlling said gear mechanism via oil pressure depending upon the operating state of said engine;

said drive mechanism including;

a hydraulic circuit having an oil supply passage passing through a cylinder head of said engine for supplying working fluid from an oil pressure source for pressurizing the working fluid to said gear mechanism and an oil exhaust passage passing through said cylinder head for exhausting the working fluid from said gear mechanism to an oil pan of said engine;

a flow control valve disposed in said cylinder head for controlling the amount of working fluid flowing through said hydraulic circuit;

means for monitoring the operating state of said engine, said monitoring means generating a control signal representative of the operating state of said engine; and an actuator for actuating said flow control valve in response to said control signal from said monitoring means.

3. The intake- and/or exhaust-valve timing control system as set forth in claim 2, wherein said flow control valve and said actuator are integrally assembled and are mounted together on said cylinder head.

4. The intake- and/or exhaust-valve timing control system as set forth in claim 3, wherein in said cylinder head, said oil supply passage and said oil exhaust passage are juxtaposed and said flow control valve is arranged in such a manner as to traverse both said oil supply and oil exhaust passages.

5. The intake- and/or exhaust-valve timing control system as set forth in claim 4, wherein said flow control valve includes a spool valve for blocking said oil supply passage and for establishing said oil exhaust passage or for blocking said oil exhaust passage and for establishing said oil supply passage.

6. The intake- and/or exhaust-valve timing control system as set forth in claim 5, wherein said spool valve includes a first valve section for blocking and establishing the oil supply passage and a second valve section for blocking and establishing said oil exhaust passage, said first valve section having a substantially annular groove at the outer peripheral surface thereof such that a slight amount of the working fluid is fed through said annular groove to said gear mechanism so as to provide lubrication of said gear mechanism when said oil supply passage is blocked by said first valve section.

7. The intake- and exhaust-valve timing control system as set forth in claim 5, wherein said actuator includes a plunger rod being capable of moving said spool valve, said spool valve and said plunger rod moving integrally with each other while the facing ends of said spool valve and said plunger rod abut each other.

* * * * *